United States Patent [19]

Helm

[11] 4,125,039

[45] Nov. 14, 1978

[54] ENGINE AND TRANSMISSION CONTROL SYSTEM

[75] Inventor: Dennis R. Helm, Peoria, Ill.

[73] Assignee: Caterpillar Tractor Co., Peoria, Ill.

[21] Appl. No.: 733,646

[22] Filed: Oct. 18, 1976

[51] Int. Cl.[2] ..... B60K 41/18; F16D 47/00

[52] U.S. Cl. ..... 74/874; 74/872; 192/0.098

[58] Field of Search ..... 74/872, 873, 874, 877; 192/0.096, 0.098; 91/413

[56] References Cited

U.S. PATENT DOCUMENTS

| | | | |
|---|---|---|---|
| 2,396,231 | 3/1946 | Brill | 192/0.098 |
| 2,571,451 | 10/1951 | Humiston | 192/0.098 |
| 2,759,578 | 8/1956 | Manzolillo | 192/0.098 |
| 2,925,156 | 2/1960 | Grant et al. | 192/0.098 |
| 2,944,645 | 7/1960 | Markham | 192/0.096 X |
| 3,100,402 | 8/1963 | Pieterse | 192/0.098 X |
| 3,401,776 | 9/1968 | Nagasaki | 74/873 X |
| 3,669,234 | 6/1972 | Mathers | 74/874 X |
| 3,727,737 | 4/1973 | Phinney | 192/0.098 |
| 3,900,090 | 8/1975 | Kobelt | 192/0.096 X |

*Primary Examiner*—Samuel Scott
*Assistant Examiner*—Lance W. Chandler
*Attorney, Agent, or Firm*—Phillips, Moore, Weissenberger, Lempio & Majestic

[57] ABSTRACT

An engine and transmission control system provides for one lever control through a first device of engine speed and direction of output shaft rotation. A second control lever is provided to control a transmission and modulated clutch in the transmission. The second control lever, positionable by the operator at intermediate positions provides for clutch slippage during maneuver operations of an engine driven water craft so that the operator of the water craft may devote more attention to maneuvering. A second embodiment provides the same modulated clutch features for dual station control.

10 Claims, 2 Drawing Figures

ENGINE AND TRANSMISSION CONTROL SYSTEM

BACKGROUND OF THE INVENTION

This invention relates to a control system for an engine and transmission. It is particularly described in relation to the marine environment wherein the engine is provided with a transmission for forward and reverse operation, the transmission including a clutch having a slipping capability through modulation of the pressure medium used for engagement of the clutch.

Powering of marine craft by internal combustion engines is well-known. Such arrangements usually include a transmission to provide a reverse capability to the output or propeller shaft. In such an arrangement, a balance between engine efficiency and propeller efficiency is necessary. It is well-known that internal combustion engines operate best at a particular speed. It is also well-known that propellers operate best at a particular speed of rotation unless the propeller is of the controllable pitch variety. In either case, a propeller is efficient in only one direction of rotation. Use of a controllable pitch propeller may facilitate reversal of the direction of propulsion of the craft in that change of direction of rotation of the propeller shaft is unnecessary. Therefore, a controllable pitch propeller equipped boat or marine craft usually does not require a transmission per se. A disadvantage of the controllable pitch propeller is the added initial expense of the pitch control mechanism and necessary complexity of the propeller shaft. Since propellers are one of the more vulnerable items in marine craft, damage to a controllable pitch propeller requiring repair or replacement entails a good deal more expense than the damaging of a fixed pitch propeller which quite frequently can be simply repaired by reshaping and balancing.

Ordinary fixed pitch propeller arrangements utilized in marine craft usually involve a forward and reverse transmission and some sort of clutching arrangement to engage the engine with the transmission. During operation the direction is selected and the clutch engaged before application of power to the engine. In order to change direction of the propeller shaft and thus acheive a change in direction of the propulsion of the marine craft itself the propeller shaft is disengaged from the engine through the use of the clutch, the reverse gear engaged and the propeller shaft reengaged with the engine. Operation through the water at slow speeds may cause the engine to "lug down" with a possible stalling during repeated reversals unless engine speed can be maintained above a certain minimum.

In work boats, such as fishing boats and crew boats, maneuverability is an important capability. Since efficient operation of the boat revolves around maneuvering, a capability to quickly back the boat without the possibility of an engine stall has resulted in boat operators "slipping" the clutch during maneuvering in order to maintain engine speed sufficiently above idle to prevent a stall. This concept also allows slow propeller speed at any engine speed for auxiliary loads and extra slow vessel speed. In order to accomplish this clutch slippage, the operator has been forced to utilize both the engine speed and direction control lever and the clutch control lever simultaneously. This, can hamper directional control of the boat since the operator must divert his attention from the helm to the engine controls.

SUMMARY OF THE INVENTION

Accordingly, this invention provides a control system which allows the operator to control the propulsion features of a marine craft, that is engine speed and direction of rotation of the output shaft including clutch engagement through the use of one control lever. A second control lever is provided for separate control of the clutch allowing modulation of clutch engagement pressure to provide clutch slippage during particular conditions.

It is an object of this invention to provide a system for controlling an engine governor, a transmission and the clutch for engagement of the engine with the transmission.

It is a further object of this invention to provide an engine governor and transmission control system which accomplishes the above object while allowing a variable modulation rate in transmission clutch engagement, the modulation rate selectable by the operator.

It is still a further object of this invention to provide a control system which accomplishes the above objects and which is operable by pneumatic means.

It is still a further object of this invention to provide a control system which accomplishes the above objects and which may be operable from more than one control station.

It is another object of this invention to provide a control system accomplishing the above objects and which is operable from one of a plurality of control stations wherein a predetermined control station may lock out all the remaining control stations by use of a single control.

Broadly stated, the invention is a control system comprising a first actuator movable in a first direction toward a first position and movable in a second direction toward a second position. This first actuator is resiliently biased to a mid position between the first and second positions. Also included is a second actuator movable in a first direction from a first position toward a second position and resiliently biased toward the first position. A first control means is movable in first and second directions from a neutral position and is operatively associated with the second actuator. The second actuator moves responsively from its first position to its second position upon movement of the first control means in the first direction from the neutral position and the second actuator also moves responsively from its first position toward its second position upon movement of the first control means in the second direction from the neutral position. A second control means is operatively associated with the first actuator for moving the first actuator. Included are means responsive to the first control means for determining the direction of movement of the first actuator.

These and other objects of the invention will become apparent from a study of the accompanying drawings and following description.

DETAILED DESCRIPTION OF THE PREFERRED EMBODIMENT

Figure 1:
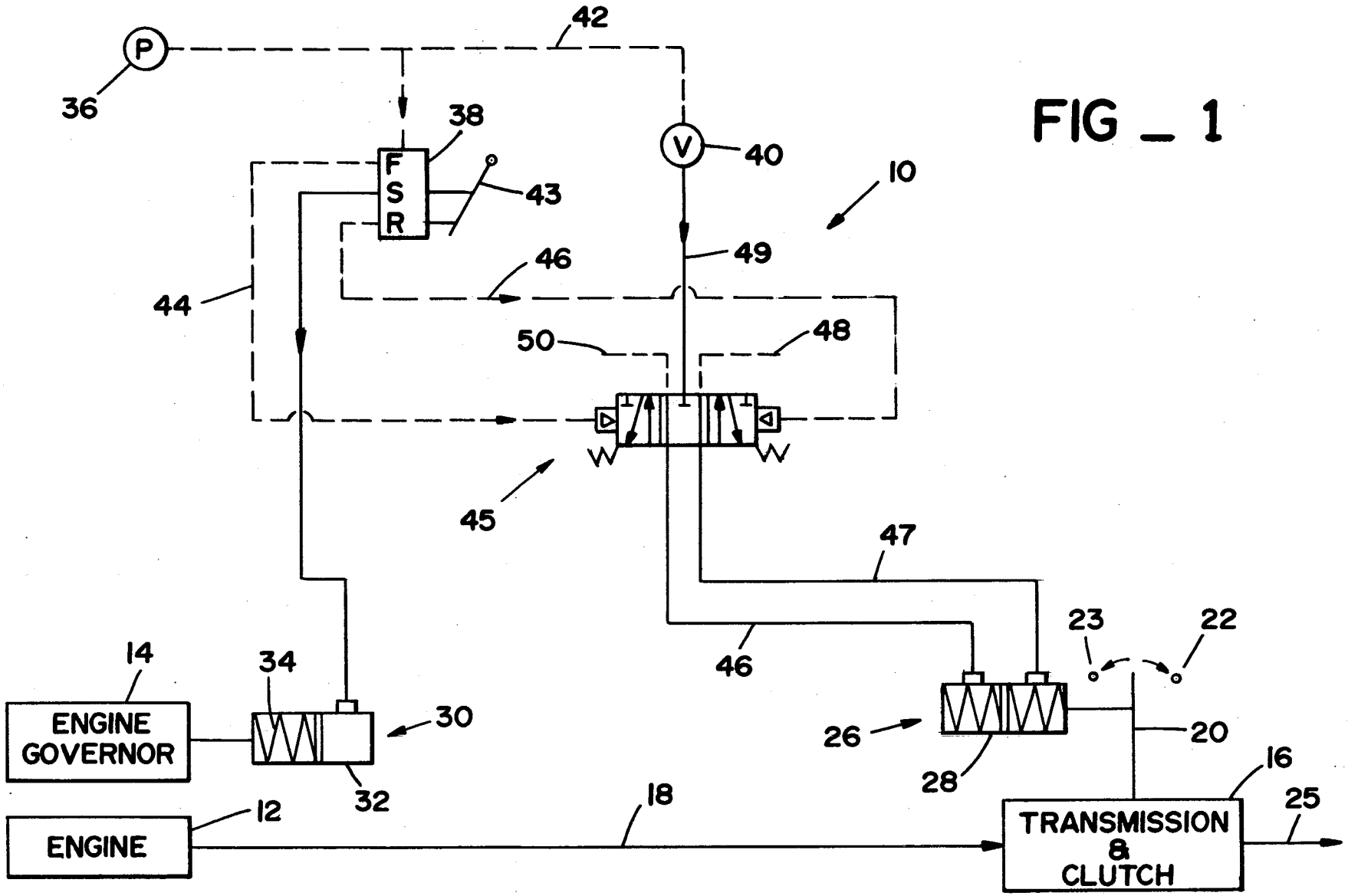
FIG. 1 illustrates schematically an engine and transmission control system in accord with the primary embodiment disclosed herein.

A control system for a modulating clutch, a transmission and an engine governor is shown schematically in FIG. 1. Although this particular arrangement is described herein in relation to a marine installation, in particular to an internal combustion engine driven marine craft, it is to be understood that the control system is applicable to other engine and transmission clutch arrangements for use in either land moving vehicles or stationary operation wherein a reversing capability and an engine governor speed control are included. Further, this embodiment and the alternate embodiment are described utilizing a pneumatic system, it is to be understood that any fluid operated arrangement may be substituted for the pneumatic system. Furthermore, the principles of operation are equally applicable to a mechanically linked device accomplishing the same purpose.

Referring specifically to FIG. 1, an engine and transmission control system 10 is illustrated. The system controls engine speed of an engine 12 (illustrated schematically) wherein speed is governed by the engine governor 14. The engine drives a transmission and clutch 16 by means of a shaft 18 or other suitable drive connection. Transmission and clutch 16 are controllable through a lever arm 20 movable in a first direction, to the right as illustrated in FIG. 1 and movable in a second direction, to the left in FIG. 1, to provide a forward and reverse capability in transmission and clutch 16. For convention sake, movement to the right in FIG. 1 is the first direction and to the left is the second direction. Furthermore in the figures, constant pressure lines are dashed and variable pressure lines are solid. Lever arm 20 is positionable in intermediate locations between the center or neutral position and the extreme positions 22 and 23 (hereinafter first and second positions) to provide differing degrees of clutch modulation, that is providing increasing pressures in the clutch as the lever arm is moved in either the first or second direction toward first and second positions 22 and 23 respectively, wherein full clutch modulation occurs or maximum engagement pressure is applied to the clutch plates. It should be understood that transmission and clutch 16 is of the type well-known in the art wherein bidirectional output may be provided to an output shaft 25 dependent upon the positioning of lever 20. Lever 20 is positioned by means of a first actuator means 26 in the form of a double acting cylinder 28 which is resiliently biased in a mid position as shown in FIG. 1 and is movable in the same first direction and second direction to position lever 20 appropriately.

The speed of engine 12 is controlled by engine governor 14 which in turn is operated by a second actuator means 30 comprised of a single acting cylinder 32 resiliently biased in a first position. As indicated in FIG. 1, single acting cylinder 32 is movable leftwardly in a second direction when urged by fluid pressure provided at the head end of the single acting cylinder and acting against the resilient biasing means 34 disposed at the rod end of the single acting cylinder 32.

A fluid pressure source 36 is included in the control system. Fluid pressure source 36 may be in the form of an engine driven pump providing a source of fluid pressure and including an accumulator (not shown) in the pneumatic system envisioned. In the event a hydraulic system is utilized, fluid pressure source 36 would include a fluid reservoir and an engine driven hydraulic pump with appropriate filters and possibly an accumulator. In the preferred embodiment, air pressure is provided to a first control means 38 and a second control means 40 through a branched conduit 42.

First control means 38, which may take the form of a commercially available pneumatic pressure control valve, provides a varying pressure to second actuator means 30 and simultaneously provides a constant pressure to one of two ports of a directional control valve means 45. Specifically, first control means 38 is operable by movement of lever means 43 in a first direction to provide an increasing air pressure to second actuator means 30 thus increasing governed speed in one rotational direction at output shaft 25. Movement of lever means 43 in a second direction provides an increasing speed in a second opposite rotating direction at output shaft 25. Movement of lever means 43 in the first direction communicates constant air pressure from conduit 42 to a conduit 44 for operatively urging a pilot operated valve means 45 in a first direction. Valve means 45, is a three position four way five ported pilot operated valve resiliently biased to the center position. Movement of lever 43 in the second opposite direction communicates air from conduit 42 to a conduit 46 which communicates with the other opposite end of valve means 45 to move the valving spool in the second direction.

Movement of the valving spool in valve means 45 in the first direction by communication of air pressure to the leftward end thereof, opens a conduit 46 communicating with the head end of double acting cylinder 28 to conduit 49 and a variable supply of air pressure provided thereto by second control means 40, while such movement simultaneously connects the rod end of double acting cylinder 28 through a conduit 47 to a vent 48. Second control means 40 which may take the form of a commercially available pneumatic pressure control valve is operable by a lever and receives pressurized air from source 36 by branched conduit 42. Movement of the lever associated with second control means 40 communicates air at controlled pressures to a conduit 49 which may be interconnected with either conduit 46 or conduit 47 by valve means 45 thus communicating with the head end or rod end respectively of double acting cylinder 28.

Operation of this embodiment should be apparent from the description set forth above, however the following brief statements are offerred in clarification.

The preferred embodiment is described in relation to a marine installation having an engine controlled by an engine governor and driving a reversing transmission through a modulating clutch. The transmission provides a forward and reverse capability to the marine craft through the means of the modulated clutch. Control of the engine speed and direction is provided through lever 43 operably movable from a neutral position in one or the other direction to provide high pressure air to position a reversing valve means 45 while simultaneously providing air at increasing pressure proportionate to the movement of lever 43 away from the neutral position to a single acting cylinder 32 resiliently biased against the air pressure to control the engine governor 14. The pilot operated reversing valve means 45, under the influence of high pressure air provided at one or the other end thereof as determined by movement of lever 43, communicates air pressure controlled by a second control means 40 to the double acting cylinder 28 which in turn is linked to the lever 20 movable in first and second directions to engage the forward or reverse gearing of the transmission in transmission and clutch 16 while modulating the clutch engagement proportional to movement of lever 20. Selection by the marine craft operator of a particular modulation of the clutch may be accomplished by second control means 40 and left at this modulation rate. During the maneuvering operations the operator then has complete control over the fore and aft motion of the marine craft by movement of lever 43 alone in either the first or second direction. Movement of the lever in the first direction will, of course, operate the craft in one direction with clutch engagement as set by second control means 40 while movement of lever 43 in the other opposite direction from the neutral position will cause the propeller shaft to be rotated in the opposite direction again at the same modulated clutch engagement. Such modulated clutch rates are thus selectable by the operator to suit the particular operating conditions. The single lever 43 allows the operator to devote full attention to maneuvering the marine craft without the necessity of determining clutch modulation during the maneuvering operations. During certain fishing operations, such as net retrieval, a constant engine speed is necessary for operation of deck winches and the like, while maneuverability is important to keep the screw from being fouled by the net. This can be accomplished by setting lever 43 at the optimum speed for winch operation and controlling speed through the water with second control means 40. It should be emphasized that modulation of the clutch is important in order to allow a degree of slippage between the engine speed and the propeller during maneuvering operations.

DESCRIPTION OF THE ALTERNATE EMBODIMENT

Figure 2:
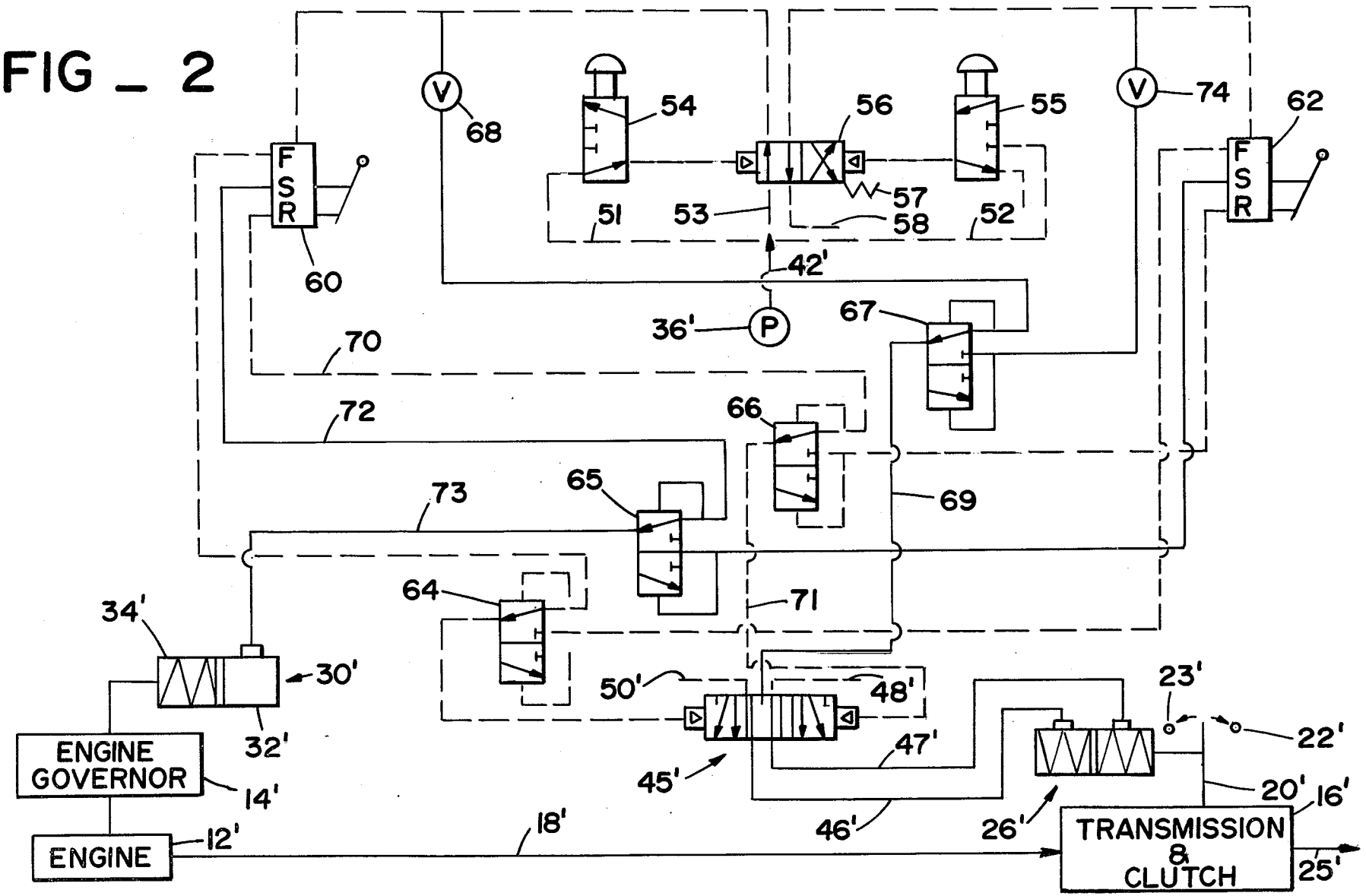
FIG. 2 illustrates an engine and transmission control system of the type depicted in FIG. 1 and adapted for dual station operation.

Shown in FIG. 2 is the control system heretofore described and adapted for use in a dual station environment. This particular embodiment would be adaptable for use in fishing craft where control during fishing operations particularly during net laying and net recovery operations is performed from a high station and control of the craft during point to point operations is performed from a lower more sheltered control station. A similar application would be found in larger craft where one station is topside for conning and the second station is in the engine room. Components in the second embodiment which correspond to components in the first embodiment carry identical numbers with the addition of a prime. An exception is made to this rule in the numbering of the first and second control means in view of the fact that there are two first control means and two second control means in the second embodiment. It should be understood that each individual first control means corresponds to the identical first control means in the primary embodiment and similarly the individual second control means in the primary embodiment.

The second embodiment illustrated in FIG. 2 is provided with a source of pneumatic pressure 36′ provided to the system by means of a conduit 42′. The convention of a dashed line for air pressure at a relatively constant pressure is maintained in the second embodiment while a solid line denotes regulated or controlled air pressure. Conduit 42′ branches to conduits 51, 52 and 53. Conduits 51 and 52 communicate pressurized air to separate selector valves 54 and 55 located at separated control stations. For convenience sake and with reference to FIG. 2, the subsystem associated with the control valve 54 on the leftward side of FIG. 2 will be denoted as the lower control station while the subsystem associated with control valve 55 on the rightward side of FIG. 2 will be denoted as the upper control station. It is to be understood that the use of the words upper and lower are not to be considered limiting. Selector valves 54 and 55 are identical and are envisioned as operated through a push button and take the form of a two position, three-way valve. Other means of operation and other valving arrangements within the scope of the art are equally applicable. Selector valves 54 and 55 operate a pilot operated two position four way valve 56 which in the present embodiment is resiliently biased to the cross over position. The two position four way valve 56 communicates pressurized air from source 36′ to the first and second control means located in the lower control station or to the first and second control means located in the upper control station dependent upon the positioning of the valve spool in the two position four way valve. Specifically, the two position four way valve 56 which is shown in the straight through position in FIG. 4, is urged to this straight through position by selector valve 54 when selector valve 54 is in the position indicated in FIG. 2. Selector valve 55 normally would be in the vent position as indicated in FIG. 2. However, selection of the upper control station by depressing the associated push button on selector valve 55 provides pressurized air to the rightward end of piloted valve 56 which acts in cooperation with the resilient member 57 to overcome the pressurized air provided to the leftward end of piloted valve 56. Therefore, the piloted valve is shifted leftwardly so that pressurized air is provided to the upper station first and second control means. Simultaneously pressurized air which had been communicated to the lower station first and second control means is vented through a vent means 58. It should be appreciated that selector valve 55 can always take control of the system because of the resilient member in the piloted valve 56. During normal operations selector valve 54 would be repositioned to vent pressurized air from the leftward end of the piloted valve 56 simultaneously with selection of the upper control subsystem by operation of selector valve 55.

Assuming now that the piloted two position four way valve 56 is in the position as shown in FIG. 2, pressurized air will then be supplied to the lower first control means 60 while the upper first control means 62 is vented through vent means 58. The valve means 45′ which is operable in response to either first control means to provide variable pressure to double acting cylinder 28′ and thus operate the transmission and clutch 16′ in either a forward or reverse direction and simultaneously provide modulated air to the clutch is isolated from upper first control means 62 by a logical arrangement of pilot operated valves 64, 65, 66 and 67. The logical arrangement of valves 64, 65, 66 and 67 is necessary because of the dual station capability operating the single engine. Each of the valves is of the two position three way design and is piloted by the pressure to be passed therethrough. For example, valve 64 is piloted to the position shown when the lever operating first control means 60 at the lower station is moved in the first or forward direction. Such movement provides pressurized air to valve 64 to urge the valve to the position indicated in FIG. 2 and thereby pass pressurized air therethrough to the left end pilot chamber of resiliently biased valve means 45′. Variable air pressure from the lower second control means 68 which operates pilot valve 67 in a manner similar to valve 64 passes valve 67 into conduit 69 then to valve means 45' to conduit 46' then to the double acting cylinder 28' for modulated operation of transmission and clutch 16'. Similarly, operation of the lever associated with the first control means 60 in the second or reverse direction provides pressurized air through conduit 70 to valve 66 which is opened by the pilot means associated with the conduit 70 to pass pressurized air therethrough into conduit 71 and thereby shift valve means 45' leftwardly to reverse the transmission and clutch 16'. Movement of the lever associated with first control means 60 in either the first or second direction provides variably pressurized air proportionate to the movement of the lever to the conduit 72 which pilots valve 65 and thus passes this variably pressurized air therethrough into conduit 73 for operation of the second actuator means 30' which is interconnected to the engine governor 14'.

Actuation of selector valve 55 shifts the two position four way valve 56 leftwardly as indicated above to pressurize the control means in the upper control station. Thus, movement of the lever associated with upper first control means 62 will shift valve 64 and 65 or 66 upwardly as shown in FIG. 2 because of the pilot features described above. Similarly, operation of upper second control means 74 shifts the valve 67 upwardly to control the variable pressurized air to valve means 45' and thus transmission 16' for modulation of the clutch contained therein.

Operation of the dual station device should be apparent from the above description, however in amplification it is pointed out that control may be selected at either of one or the other stations by actuation of a valve means 54 or 55. It is important to note that valve means 54 cannot take control from valve means 55 because the resilient means 57 in combination with air pressure supplied to the pilot chamber of valve 56 from selector valve 55 cannot be overpowered by air pressure supplied to the leftward end of the valve 56 by selector valve 54. Accordingly, selector valve 55 should be located at a master control station where control may be passed to valve 54 which may be located at a secondary station. Once selection of the control station has been made operation of the dual system follows that of the single control station system except for the shifting of the piloted valves 64, 65, 66 and 67.

Although this invention has been described in relation to a marine installation it is to be understood that other variations are to be considered in the purview of this specification.

What is claimed is:

1. A control system for positioning first and second actuators, the first actuator including a double acting cylinder resiliently biased to a mid position, the second actuator including a single acting cylinder resiliently biased to a first position, the control system comprising:

a source of fluid pressure;

first control valve means operatively associated with the second actuator and movable from a neutral position in first and second directions for communicating fluid under pressure from said source of fluid pressure to said second actuator at varying pressures directly proportional to said movement of said first control valve means from said neutral position;

second control valve means operatively associated with the first actuator and movable from a neutral position in a first direction to supply fluid under pressure from said source of fluid pressure for communication to the first actuator at varying pressures directly proportional to said movement of said second control valve means from said neutral position; and directional valve means interconnecting the second control valve means and the first actuator and responsive to movement of the first control valve means in said first direction for causing said fluid under varying pressures to be communicated to said first actuator from said second control valve means to urge said double acting cylinder in a first direction, and said directional valve means responsive to movement of the first control valve means in said second direction for causing said fluid under varying pressures to be communicated to said first actuator from said second control valve means to urge said double acting cylinder in a second direction.

2. The control system set forth in claim 1 wherein the fluid under varying pressure communicated to the second actuator urges the single acting cylinder from its first position toward a second position.

3. The control system set forth in claim 1 wherein the directional control valve means comprises a three position pilot operated valve resiliently biased to the center neutral position.

4. The control system set forth in claim 3 wherein movement of the first control valve means in the first direction acts to pilot the three position pilot operated valve to a first position, and movement of the first control valve means in a second direction acts to pilot the three position pilot operated valve to a second position.

5. The control system set forth in claim 1 further comprising:

third control valve means associated with the second actuator and movable from a neutral position in first and second directions for providing fluid from the source of fluid pressure at increasing pressures proportional to said movement;

fourth control valve means movable from a neutral position in a first direction for providing fluid from said source of fluid pressure at increasing pressures proportional to said movement;

first valve means operable for connecting the third and fourth control valve means to said source of fluid pressure while simultaneously disconnecting said first and second control valve means from said source of fluid pressure;

second valve means responsive to fluid pressure communicated from said first control valve means and responsive to fluid pressure communicated from said third control valve means for communicating variable fluid pressure from said first control valve means and said third control valve means to the second actuator and for communicating fluid pressure to the directional valve means; and third valve means responsive to fluid pressure communicated from said second control valve means and responsive to fluid pressure communicated from said fourth control valve means for communicating variable fluid pressure from the second control valve means and for communicating fluid pressure from the fourth control valve means to the directional valve means.

6. The control system as set forth in claim 5 wherein the first valve means comprises a two position four way pilot operated valve communicating fluid pressure from the source of fluid pressure to the first and second control valve means while in its first position and venting fluid pressure in the third and fourth control valve means; and communicating fluid pressure to the third and fourth control valve means when in its second position while venting fluid pressure from the first and second control valve means;

remote means for positioning the two position four way valve from its first to its second position.

7. The control system as set forth in claim 6 wherein the two position four way valve is resiliently biased to its first position.

8. An engine control system for a governed engine driving a bidirectional transmission and a modulating drive engagement clutch for drivingly connecting the transmission with an output shaft, the engine control system comprising:

a source of fluid pressure;

first actuator means responsive to fluid pressure and operatively connected to the bidirectional transmission for modulating the engagement of the drive engagement clutch, wherein said first actuator means is movable in a first direction toward a first position to engage the clutch for output shaft rotation in a first direction and movable in a second direction toward a second position to engage the clutch for output shaft rotation in the other opposite direction;

second actuator means responsive to fluid pressure for operating the engine governor;

first control means having a first position and movable therefrom in first and second directions and operatively associated with the second actuator for providing fluid under pressure to said second actuators, said pressure increasing proportionately to movement of the first control means;

second control means operatively associated with the first actuator and movable from a neutral position for providing fluid pressure to the first actuator at pressures proportional to the movement of the second control means valve means interconnecting said second control means and said first actuator and responsive to movement of said first control means, said valve means responsive to movement of the first control means for determining direction of movement of the first actuator.

9. The engine control system set forth in claim 8 wherein the second actuator means is movable in a first direction toward a first position to increase engine speed and movable in a second direction toward a second position to decrease engine speed, said second actuator means resiliently biased in said second direction.

10. The engine control system set forth in claim 9 wherein the first actuator means is resiliently biased to a mid position so that the clutch is disengaged in said mid position.

* * * * *